US007226009B2

(12) United States Patent
Matlin et al.

(10) Patent No.: US 7,226,009 B2
(45) **Date of Patent: *Jun. 5, 2007**

(54) SHREDDER WITH PIVOTING HOUSING FOR THE SHREDDER MECHANISM

(75) Inventors: Taihoon K. Matlin, Round Lake Beach, IL (US); David G. Hartnett, Carol Stream, IL (US); Devin Lee Moore, Decatur, GA (US); Matthew Luis Rivera, Mableton, GA (US); Nheeda C Enriquez, Jersey City, NJ (US)

(73) Assignee: Fellowes Inc., Itasca, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/346,304

(22) Filed: Feb. 3, 2006

(65) Prior Publication Data

US 2006/0124789 A1 Jun. 15, 2006

Related U.S. Application Data

(63) Continuation of application No. 10/828,254, filed on Apr. 21, 2004, now Pat. No. 7,025,293.

(51) Int. Cl.
*B02C 18/16* (2006.01)

(52) U.S. Cl. ..... 241/100; 241/236; 241/285.3

(58) Field of Classification Search ..... 241/100, 241/236, 285.2, 285.3
See application file for complete search history.

(56) References Cited

U.S. PATENT DOCUMENTS

| | | | |
|---|---|---|---|
| 3,419,223 | A | 12/1968 | Morin |
| 4,172,400 | A | 10/1979 | Brierley |
| 4,564,146 | A | 1/1986 | Bleasdale |
| 4,637,560 | A | 1/1987 | Goldhammer |
| 4,973,004 | A | 11/1990 | Krause et al. |
| D362,866 | S | 10/1995 | Johansson |
| D375,973 | S | 11/1996 | Kennedy et al. |
| 5,826,809 | A | 10/1998 | Kroger |
| 5,839,675 | A | 11/1998 | Henreckson et al. |
| 5,853,131 | A | 12/1998 | Cheng |
| D404,756 | S | 1/1999 | Dziersk |
| D412,716 | S | 8/1999 | Kroger |
| 5,961,059 | A | 10/1999 | Kroger |
| 5,969,310 | A | 10/1999 | Schwelling |
| 5,988,542 | A | 11/1999 | Henreckson et al. |
| 6,079,645 | A | 6/2000 | Henreckson et al. |
| D434,433 | S | 11/2000 | Hung |
| D437,343 | S | 2/2001 | Ho |
| D451,948 | S | 12/2001 | Wu et al. |

(Continued)

FOREIGN PATENT DOCUMENTS

| | | |
|---|---|---|
| DE | 36 07 752 | 9/1987 |

(Continued)

OTHER PUBLICATIONS

International Search Report from PCT/US2005/012611.

*Primary Examiner*—Mark Rosenbaum
(74) *Attorney, Agent, or Firm*—Pillsbury Winthrop Sahw Pittman LLP

(57) ABSTRACT

The present invention relates to a shredder wherein the shredder housing can be pivoted between a generally horizontal orientation and a generally vertical orientation.

15 Claims, 8 Drawing Sheets

U.S. PATENT DOCUMENTS

| | | | |
|---|---|---|---|
| D455,170 | S | 4/2002 | Ho |
| 6,460,790 | B1 | 10/2002 | Wu Huang |
| D474,231 | S | 5/2003 | Lammers et al. |
| D481,416 | S | 10/2003 | Chang |
| 2005/0072869 | A1 | 4/2005 | Ting |

FOREIGN PATENT DOCUMENTS

| | | |
|---|---|---|
| DE | 296 22 139 | 4/1997 |
| DE | 196 18 478 | 9/1997 |
| EP | 0010681 | 5/1980 |

SHREDDER WITH PIVOTING HOUSING FOR THE SHREDDER MECHANISM

CROSS REFERENCE TO RELATED APPLICATION

This application is a continuation of U.S. application Ser. No. 10/828,254, filed Apr. 21, 2004, now issued as U.S. Pat. No. 7,025,293, the entire contents of which are incorporated herein by reference.

FIELD OF THE INVENTION

The present invention relates to shredders for destroying articles, such as documents, CDs, etc.

BACKGROUND OF THE INVENTION

Shredders are well known devices for destroying articles, such as documents, CDs, floppy disks, etc. Typically, users purchase shredders to destroy sensitive articles, such as credit card statements with account information, documents containing company trade secrets, etc.

A common type of shredder has a shredder mechanism contained within a housing that is removably mounted atop a container. The shredder mechanism typically has a series of cutter elements that shred articles fed therein and discharge the shredded articles downwardly into the container. When it is desired to service the shredder mechanism, or clear jammed articles from the cutter elements, the housing is typically lifted off the container to provide access to the underside of the shredder mechanism or for emptying the container. Typically, this is done by lifting the housing vertically off the container with two hands.

The present invention endeavors to provide a simpler and more ergonomically efficient approach to removing the shredder housing from its operative position on a container.

SUMMARY OF THE INVENTION

One aspect of the present invention provides a shredder comprising a seat, a shredder housing, and a shredder mechanism including a motor and cutter elements. The shredder mechanism enables articles to be shredded to be fed into the cutter elements and the motor is operable to drive the cutter elements so that the cutter elements shred the articles fed therein.

The seat has a pivot guide and the shredder housing includes a pivot mount. The shredder housing is constructed to be removably mounted to the seat in a generally horizontal orientation with the pivot mount removably engaged with the pivot guide. The pivot mount and the pivot guide are constructed to pivotally mount the shredder housing for pivotal movement between the generally horizontal orientation and a generally vertical orientation.

Another aspect of the invention provides a shredder with a waste opening feature. The shredder of this aspect of the invention comprises a seat, a shredder housing, and a shredder mechanism including a motor and cutter elements. The shredder mechanism enables articles to be shredded to be fed into the cutter elements and the motor is operable to shred the articles fed therein. The shredder mechanism is mounted in the shredder housing. The shredder housing is constructed to be removably mounted to the seat.

The shredder housing includes a waste opening spaced apart from the shredder mechanism for enabling articles to be discarded through the waste opening without passing through the shredder mechanism. A handle is coupled to the shredder housing and facilitates removal of the shredder housing from the seat. The handle defines at least a portion of the waste opening.

Other objects, features, and advantages of the present invention will become apparent from the following detailed description, the accompanying drawings, and the appended claims.

DETAILED DESCRIPTION OF THE ILLUSTRATED EMBODIMENTS

FIGS. 1–8 illustrate an embodiment of a shredder constructed in accordance with one embodiment of the present invention. The shredder is generally indicated at 10. The shredder 10 sits atop a waste container, generally indicated at 12, which is formed of molded plastic or any other material. The shredder 10 illustrated is designed specifically for use with the container 12, as the shredder housing 14 sits on the upper periphery of the waste container 12 in a nested relation, which will be discussed in further detail below. Generally speaking, the shredder 10 may have any suitable construction or configuration and the illustrated embodiment is not intended to be limiting in any way.

Figure 8:
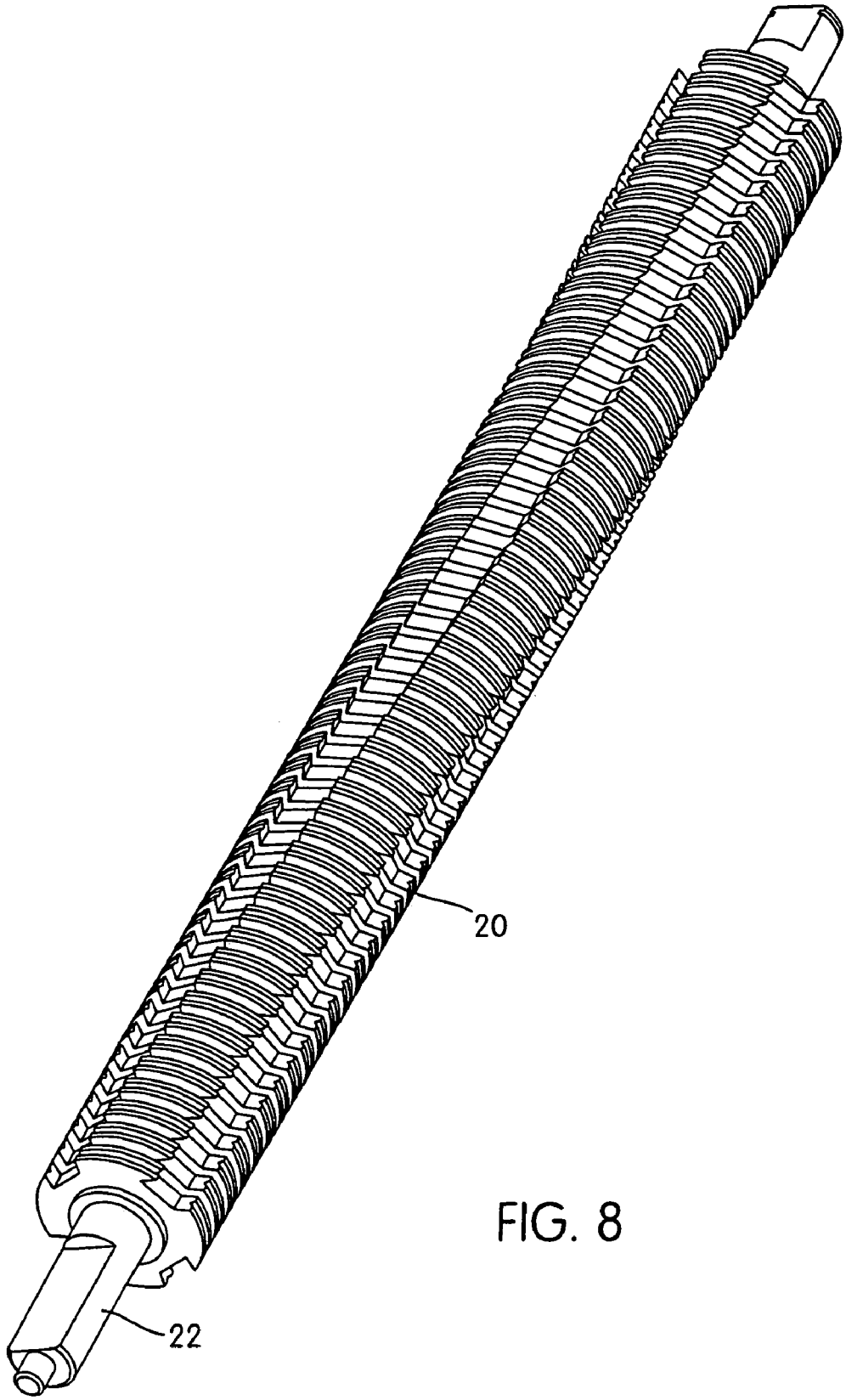
FIG. 8 is a perspective view of a shaft and cutter element used in the shredder.

The shredder 10 includes a shredder mechanism 16 including an electrically powered motor 18 and a plurality of cutter elements 20. The cutter elements 20 are mounted on a pair of parallel rotating shafts 22, one of which is shown in FIG. 8. The motor 18 operates using electrical power to rotatably drive the shafts 22 and the cutter elements 20 through a conventional transmission 23 so that the cutter elements 20 shred articles fed therein. The shredder mechanism 16 may also include a sub-frame 21 for mounting the shafts 22, the motor 18 and the transmission 23. The operation and construction of such a shredder mechanism 16 are well known and need not be described herein in detail. Generally, any suitable shredder mechanism 16 known in the art or developed hereafter may be used.

The shredder 10 also includes the shredder housing 14, mentioned above. The shredder housing 14 includes top wall 24 that sits atop the container 12. The top wall 14 is molded from plastic and an opening 26 is located at a front portion thereof. The opening 26 is formed in part by a downwardly depending generally U-shaped member 28. The U-shaped member 28 has a pair of spaced apart connector portions 27 on opposing sides thereof and a hand grip portion 28 extending between the connector portions 27 in spaced apart relation from the housing 14. The opening 26 allows waste to be discarded into the container 12 without being passed through the shredder mechanism 16, and the member 28 may act as a handle for carrying the shredder 10 separate from the container 12. As an optional feature, this opening 26 may be provided with a lid, such as a pivoting lid, that opens and closes the opening 26. However, this opening in general is optional and may be omitted entirely. Moreover, the shredder housing 14 and its top wall 24 may have any suitable construction or configuration.

The shredder housing 14 also includes a bottom receptacle 30 having a bottom wall, four side walls and an open top. The shredder mechanism 16 is received therein, and the receptacle 30 is affixed to the underside of the top wall 24 by fasteners. The receptacle 30 has an opening 32 in its bottom wall through which the shredder mechanism 16 discharges shredded articles into the container 12. For more details on this structure, reference may be made to the U.S. Patent Application Ser. No. 10/815,761, by Taihoon K. Matlin et al., entitled Shredder with Lock for On/Off Switch filed Apr. 2, 2004, the entirety of which is hereby incorporated into the present application by reference.

The top wall 24 has a generally laterally extending opening 36 extending generally parallel and above the cutter elements 20. The opening 36, often referred to as a throat, enables the articles being shredded to be fed into the cutter elements 20. As can be appreciated, the opening 36 is relatively narrow, which is desirable for preventing overly thick items, such as large stacks of documents, from being fed into cutter elements 20, which could lead to jamming. The opening 36 may have any configuration.

The top wall 24 also has a switch recess 38 with an opening therethrough. An on/off switch 42 includes a switch module (not shown) mounted to the top wall 24 underneath the recess 38 by fasteners, and a manually engageable portion 46 that moves laterally within the recess 38. The switch module has a movable element (not shown) that connects to the manually engageable portion 46 through the opening 40. This enables movement of the manually engageable portion 46 to move the switch module between its states.

In the illustrated embodiment, the switch module connects the motor 18 to the power supply (not shown). Typically, the power supply will be a standard power cord 44 with a plug 48 on its end that plugs into a standard AC outlet. The switch 42 is movable between an on position and an off position by moving the portion 46 laterally within the recess 38. In the on position, contacts in the switch module are closed by movement of the manually engageable portion 46 and the movable element to enable a delivery of electrical power to the motor 18. In the off position, contacts in the switch module are opened to disable the delivery of electric power to the motor 18.

As an option, the switch 42 may also have a reverse position wherein contacts are closed to enable delivery of electrical power to operate the motor 18 in a reverse manner. This would be done by using a reversible motor and applying a current that is of a reverse polarity relative to the on position. The capability to operate the motor 18 in a reversing manner is desirable to move the cutter elements 20 in a reversing direction for clearing jams. In the illustrated embodiment, in the off position the manually engageable portion 46 and the movable element would be located generally in the center of the recess 38, and the on and reverse positions would be on opposing lateral sides of the off position.

Generally, the construction and operation of the switch 42 for controlling the motor 42 are well known and any construction for such a switch 42 may be used.

The top cover 24 also includes another recess 50 associated with a switch lock 52. The switch lock 52 includes a manually engageable portion 54 that is movable by a user's hand and a locking portion (not shown). The manually engageable portion 54 is seated in the recess 50 and the locking portion is located beneath the top wall 24. The locking portion is integrally formed as a plastic piece with the manually engageable portion 54 and extends beneath the top wall 24 via an opening formed in the recess 50.

The switch lock 52 causes the switch 42 to move from either its on position or reverse position to its off position by a camming action as the switch lock 52 is moved from a releasing position to a locking position. In the releasing position, the locking portion is disengaged from the movable element of the switch 42, thus enabling the switch 42 to: be moved between its on, off, and reverse positions. In the locking position, the movable element of the switch 42 is restrained in its off position against movement to either its on or reverse position by the locking portion of the switch lock 52.

Preferably, but not necessarily, the manually engageable portion 54 of the switch lock 52 has an upwardly extending projection 56 for facilitating movement of the switch lock 52 between the locking and releasing positions.

One advantage of the switch lock 52 is that, by holding the switch 42 in the off position, to activate the shredder mechanism 16 the switch lock 52 must first be moved to its releasing position, and then the switch 42 is moved to its on or reverse position. This reduces the likelihood of the shredder mechanism 16 being activated unintentionally.

The construction and operation of the switch lock 52 and its relationship with the switch 42 is described in further detail in the U.S. patent application of Matlin et al. mentioned above.

In the illustrated embodiment, the shredder housing 14 is designed specifically for use with the container 12 and it is intended to sell them together. The upper peripheral edge 60 of the container 12 defines an upwardly facing opening 62, and provides a seat 61 on which the shredder 10 is removably mounted. The seat 61 includes a pair of pivot guides 64 provided on opposing lateral sides thereof. The pivot guides 64 include upwardly facing recesses 66 that are defined by walls extending laterally outwardly from the upper edge 60 of the container 12. The walls defining the recesses 66 are molded integrally from plastic with the container 12, but may be provided as separate structures and formed from any other material. At the bottom of each recess 66 is provided a step down or ledge providing a generally vertical engagement surface 68. This step down or ledge is created by two sections of the recesses 66 being provided with different radii.

The shredder housing 14 has a pair of pivot mounts 70 provided on opposing lateral sides thereof. Each of the pivot mounts 70 includes a wall 72 extending laterally outwardly that has a generally semi-circular configuration. The walls 72 are molded integrally from plastic with the housing 14, but may be provided as separate structures and formed from any other material. The configuration generally corresponds to the configuration of the recesses 66 on the container 12. During normal usage, the shredder 10 is removably mounted in a generally horizontal orientation on the upper peripheral edge 60 of the container 12 with the pivot mounts 70, particularly the semi-circular walls 72, received in the upwardly facing recesses 66 of the pivot guides 64. This is shown best in FIGS. 4, 6 and 7.

Figure 1:
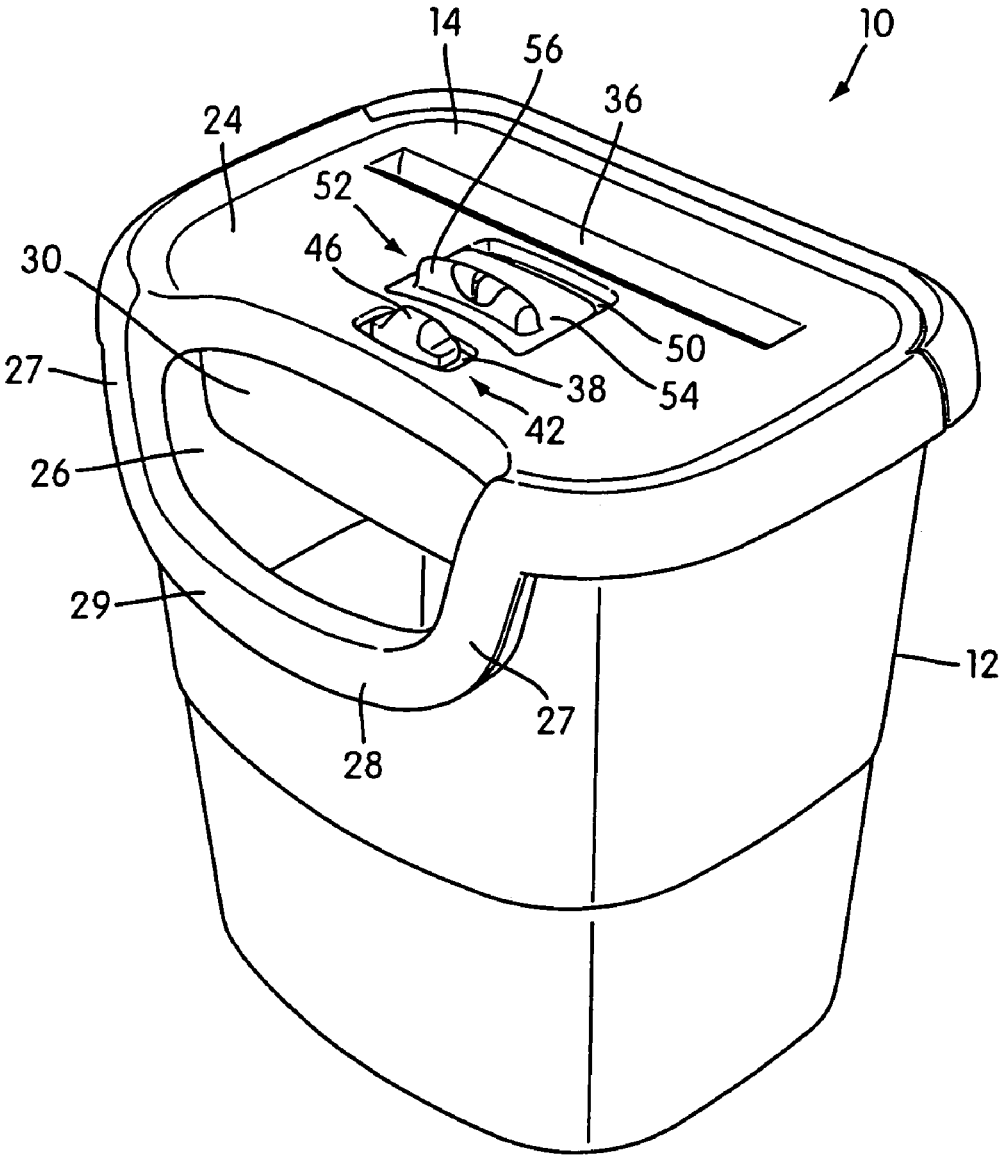
FIG. 1 is a perspective view of a shredder constructed in accordance with an embodiment of the present invention.
Figure 2:
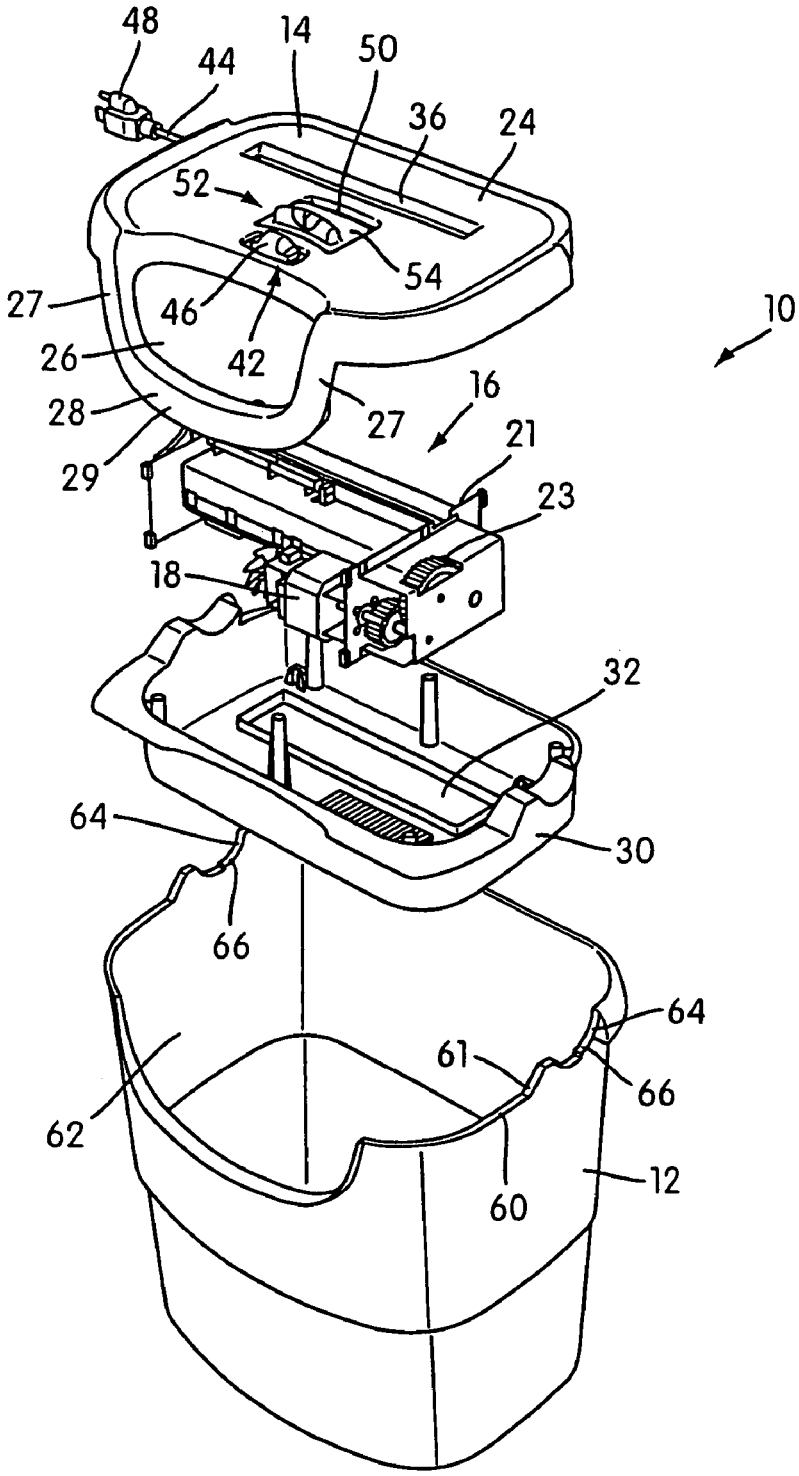
FIG. 2 is an exploded perspective view of the shredder of FIG. 1.
Figure 3:
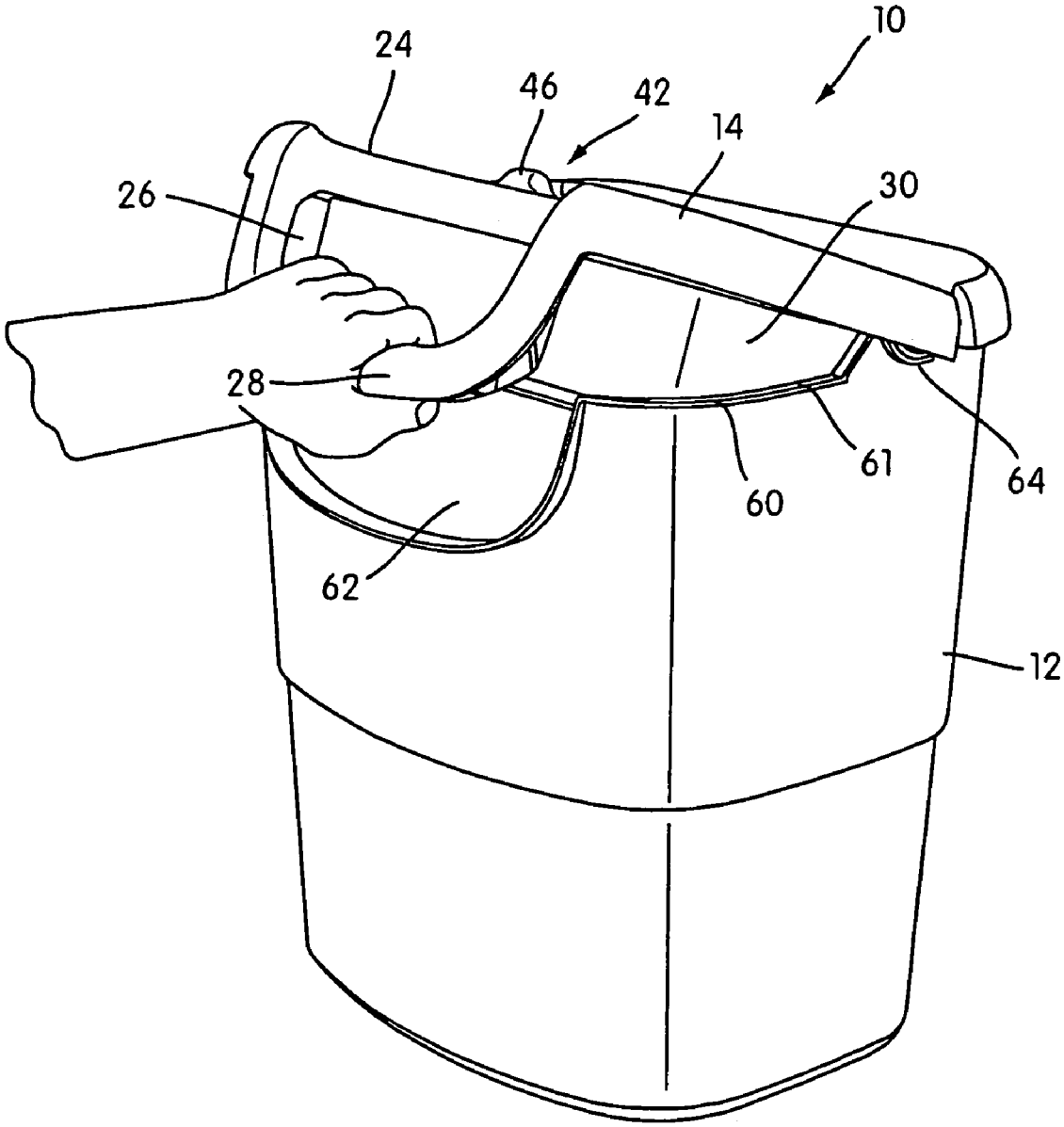
FIG. 3 is a perspective view of the shredder of FIG. 1, showing the shredder being pivoted from its generally horizontal use position.
Figure 4:
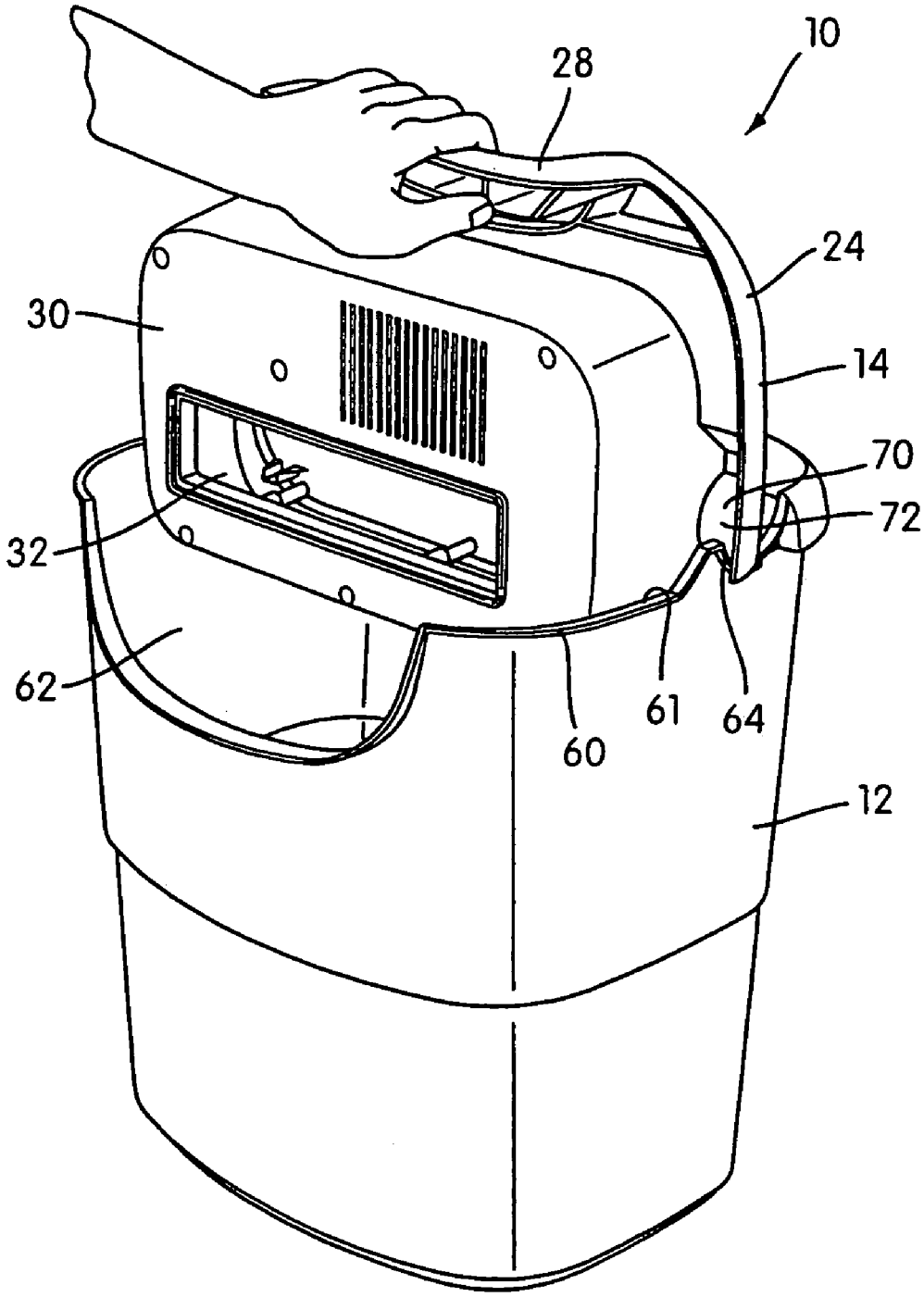
FIG. 4 is a perspective view of the shredder of FIG. 1, showing the shredder in its generally vertical orientation.
Figure 5:
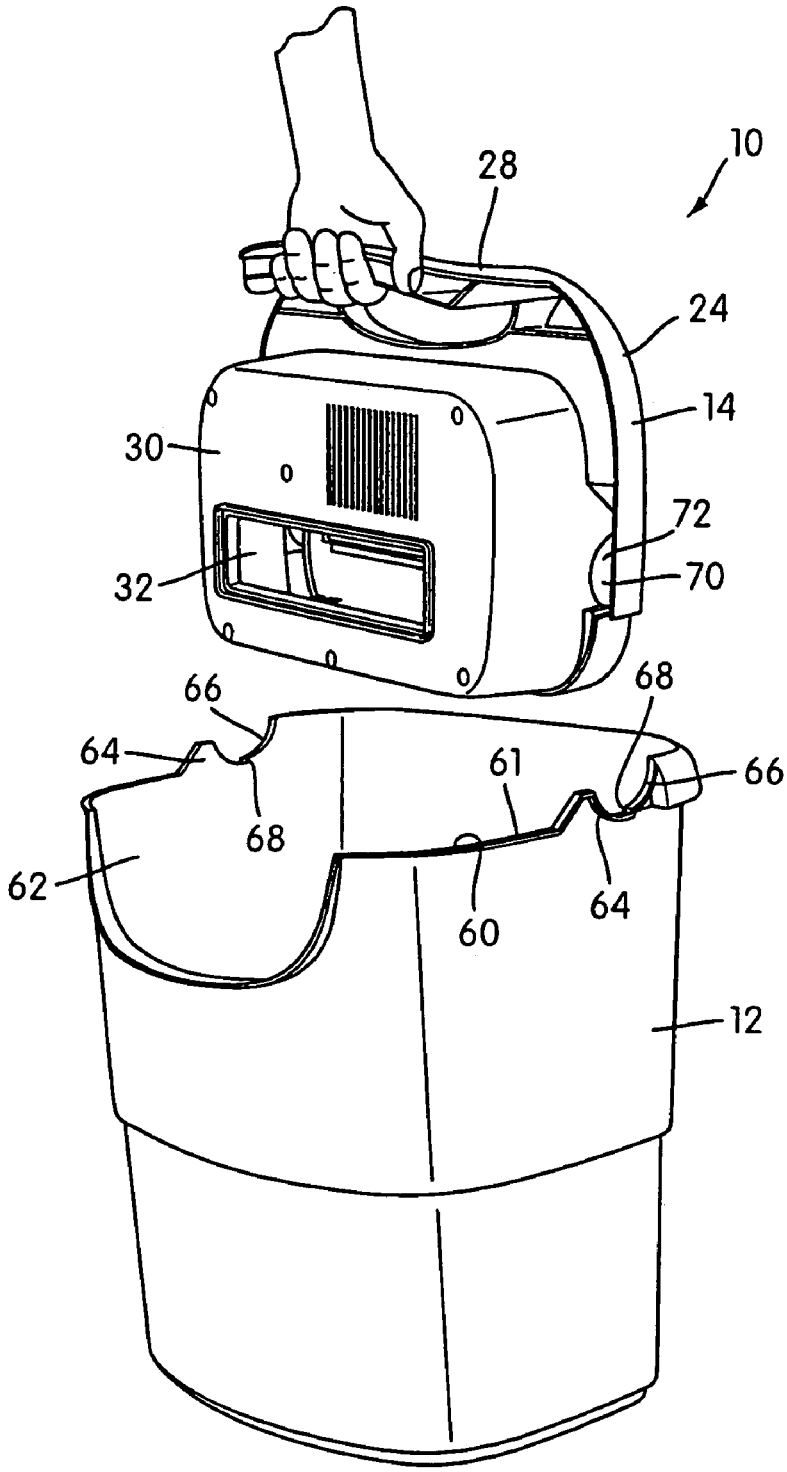
FIG. 5 is a perspective view of the shredder of FIG. 1, showing the shredder being lifted off of the container.
Figure 6:
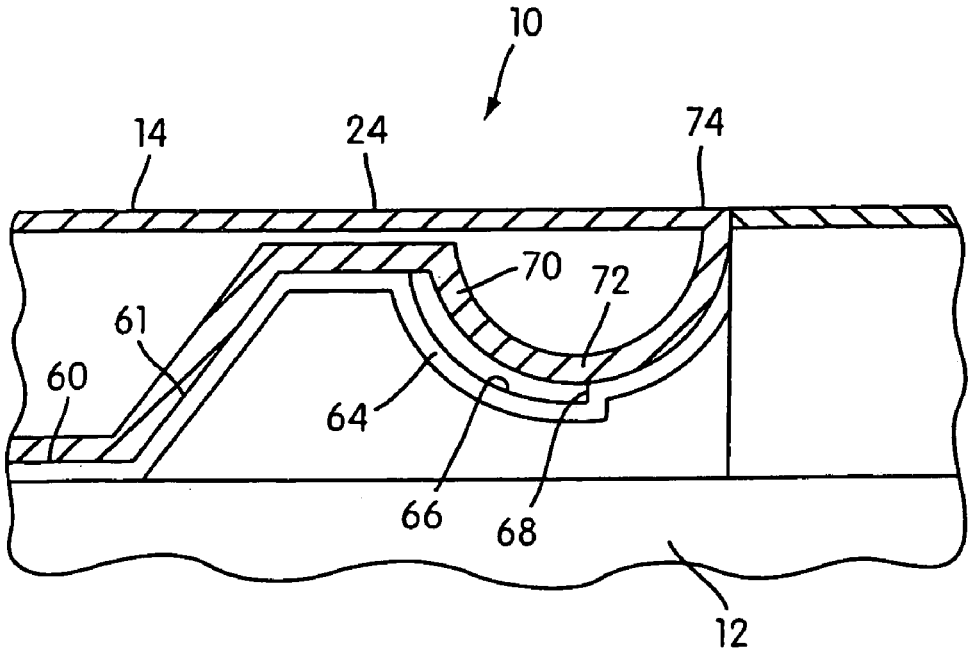
FIG. 6 is a cross-sectional view showing the pivot mount and the pivot guide of the shredder of FIG. 1 in its generally horizontal orientation.

To remove the shredder 10 from the container 12 for purposes of emptying the container 12 or clearing a jam from the underside of the shredder mechanism 16, the user can manually grab the handle 28 with his/her hand as shown in FIG. 3. Then the user can pivot the shredder 10 by the handle 28 up to the generally vertical position shown in FIG. 4. Next, the user can lift the shredder 10 generally vertically off the upper peripheral edge 62 of the container 12, as shown in FIG. 5.

Figure 7:
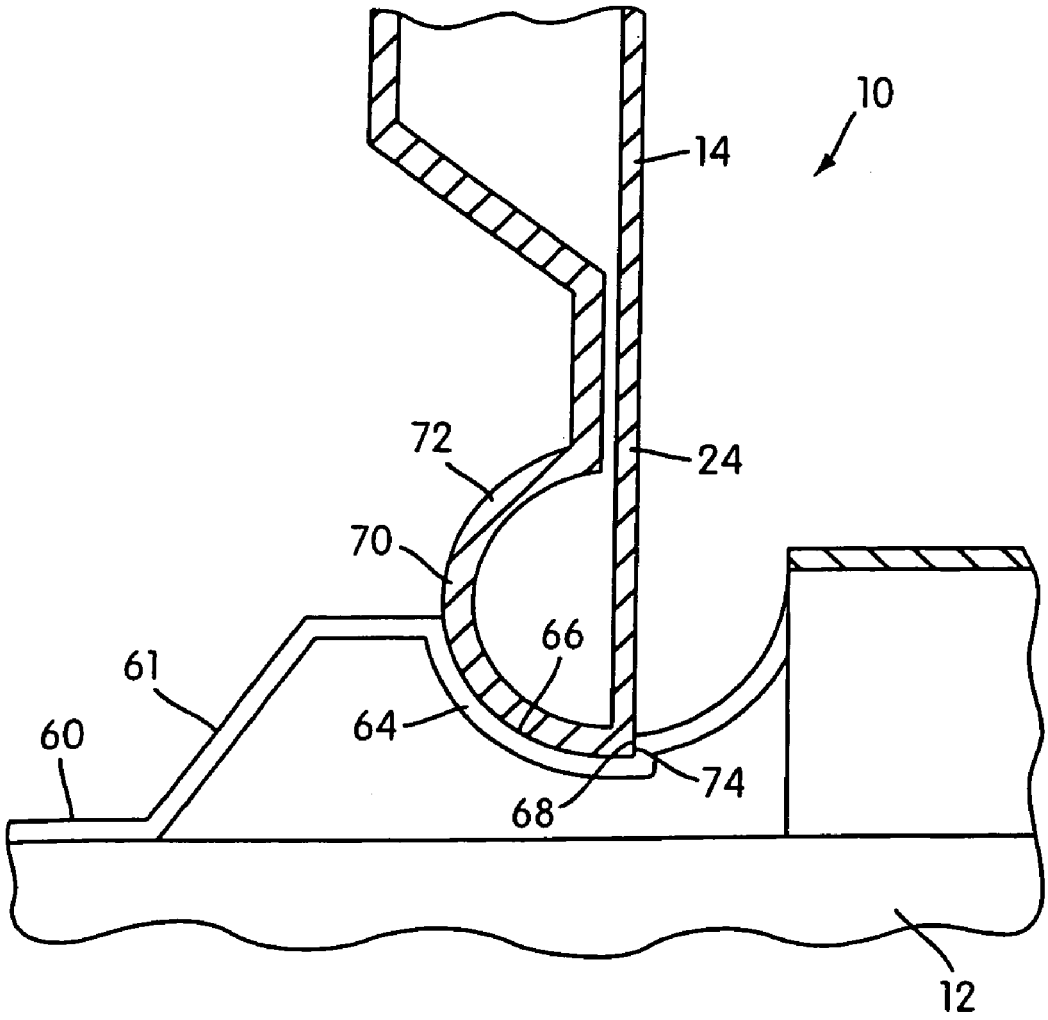
FIG. 7 is a cross-sectional view similar to FIG. 6 with the shredder in its generally vertical position.

As can be seen in FIG. 7, when the shredder 10 is in its generally vertical position, surfaces 74 at the upper edges of the walls 72 engage the engagement surfaces 68 on the recesses 66. This engagement provides support to the shredder 10 against movement thereof back towards the generally horizontal orientation. This is advantageous because it allows the user to easily lift the shredder 10 up off the seat 61. Also, when placing the shredder 10 back on the seat 61 (which is done by reversing the removal steps), the engagement between the surfaces 74 at the upper edges of the walls 72 and the engagement surfaces 68 help ensure proper location of the shredder 10.

It should be noted that the pivot guides 64 and the pivot mounts 70 may have any suitable construction or configuration and the example illustrated is in no way intended to be limiting.

In an alternative embodiment, the seat 61 could be a structure that is separate from the container 12 and could be designed for use with other types of containers. For example, the seat could be constructed so as to be adjustable for purposes of being removably mounted on a wide variety of containers. This would allow an end user to "retrofit" any type of container, such as a typical wastebasket, into a shredder container with the seat supporting the shredder 10. In this exemplary alternative, the shredder 10 and seat cold be sold together without the container, thus reducing packaging size and space. As such, the term seat is used herein to refer to any structure to which a shredder is mounted, and it is not limited to a seat that is integrally formed with a container as illustrated.

The foregoing illustrated embodiment has been provided to illustrate the structural and functional principles of the present invention and is not intended to be limiting. To the contrary, the present invention is intended to encompass all modifications, alterations and substitutions within the spirit and scope of the appended claims.

What is claimed is:

1. A shredder comprising:

a shredder housing;

a seat constructed to have said shredder housing removably received thereon in a generally horizontal orientation;

a shredder mechanism including a motor and cutter elements, the shredder mechanism enabling articles to be shredded to be fed into the cutter elements and the motor being operable to drive the cutter elements so that the cutter elements shred the articles fed therein, the shredder mechanism being mounted in the shredder housing;

a handle provided on the shredder housing, the handle being constructed to be manually grasped for moving the shredder housing on the seat between the generally horizontal orientation and a generally vertical orientation and for lifting and lowering the shredder housing off of and onto the seat;

the seat and the shredder housing including portions removably engaged together for guiding the shredder housing for pivotal movement between the generally horizontal and generally vertical orientations, the removable engagement of the portions enabling the shredder housing to be removed upwardly from the seat.

2. A shredder according to claim 1, wherein one of the removably engaged portions of the seat and the shredder housing includes an open recess receiving the other removably engaged portion for guiding the shredder housing for the pivotal movement between the generally horizontal and generally vertical orientations.

3. A shredder according to claim 2, wherein the seat includes the open recess and the recess opens upwardly.

4. A shredder according to claim 1, wherein a pair of said removably engaged portions is on each opposing lateral side of the shredder.

5. A shredder according to claim 4, wherein the removably engaged portions includes a pair of an upwardly facing recesses on opposing lateral sides of the seat, and a pair of pivot members on opposing lateral sides of the shredder housing, the pivot members being pivotally and removably engaged in the upwardly facing recesses.

6. A shredder according to claim 1, wherein the seat is constructed to be removably mounted on an upper portion of a container having an upwardly facing opening so that the articles being shredded and discharged from the cutter elements are discharged into the container.

7. A shredder according to claim 1, wherein the handle is provided on a front portion of the shredder housing.

8. A shredder according to claim 1, further comprising a container, wherein the seat is provided by an upper peripheral edge of the container so that the articles being shredded and discharged from the cutter elements are discharged into the container.

9. A paper shredder comprising:

a shredder cover including a shredder for shredding paper, said shredder cover having an upper face formed with a paper entrance and a lower face formed with a paper exit, said shredder cover further having two opposite sides interconnecting said upper and lower faces and two pivot members provided respectively on said opposite sides; and a shred container disposed below said shredder cover to receive shreds from said shredder, said shred container having an open end which includes two opposite edges respectively provided with pivot seats, said pivot members being removably mounted respectively on said pivot seats so that said shredder cover is removably mounted on said shred container and said shredder cover is turnable about the axes of said pivot members, the removable mounting of the pivot members enabling the shredder cover to be manually removed and separated from the shred container in an upward direction.

10. The paper shredder according to claim 9, wherein said shredder cover includes a handle at one side of said pivot members which are symmetrically opposite to each other, said handle capable of being used as the point of force application for turning and opening said shredder cover, whereby said shredder cover can be rotated about the axes of said pivot members.

11. The paper shredder according to claim 10, wherein said shredder cover is rotated about the axes of said pivot members between an open position, in which said shredder cover is turned to an angular position so as to expose said open end of said shred container to permit access to said shred container, and a closed position, in which said shredder cover covers said open end of said shred container.

12. The paper shredder according to claim 11, wherein each of said pivot seats is in the form of a curved wall that is indented downwardly from said open end of said shred container, each of said pivot members being at least partially cylindrical in cross-section, one of said shredder cover and said pivot seats further comprising a pair of rotation limiting members, each of the rotation limiting members projecting radially, and each being adapted to abut against a respective edge on the other of said shredder cover and said pivot seats so as to restrict angular rotation of said shredder cover relative to said shred container when said shredder cover is turned to said open position.

13. The paper shredder according to claim 9, further comprising an on/off switch that is disposed on said shredder cover that is electrically connected to said shredder for activating and de-activating said shredder.

14. A paper shredder comprising:

a shredder cover including a shredder for shredding paper, said shredder cover having an upper face formed with a paper entrance and a lower face formed with a paper exit, said shredder cover further having two opposite sides interconnecting said upper and lower faces and two pivot members provided respectively on said opposite sides; and a shred container disposed below said shredder cover to receive shreds from said shredder, said shred container having an open end which includes two opposite edges respectively provided with pivot seats, said pivot members being mounted respectively on said pivot seats so that said shredder cover is mounted on said shred container and said shredder cover is turnable about the axes of said pivot members;

wherein each of said pivot seats is in the form of a curved wall that is indented downwardly from said open end of said shred container, each of said pivot members being at least partially cylindrical in cross-section, one of said shredder cover and said pivot seats further comprising a pair of rotation limiting members and the other of said shredder cover and pivot seats further comprising a pair of engagement surfaces, each of rotation limiting members projecting radially, and each being adapted to abut against a respective one of said engagement surfaces so as to restrict angular rotation of said shredder cover relative to said shred container when said shredder cover is turned to said open position.

15. A paper shredder comprising:

a shredder cover including a shredder for shredding paper, said shredder cover having an upper face formed with a paper entrance and a lower face formed with a paper exit, said shredder cover further having two opposite sides interconnecting said upper and lower faces and two pivot members provided respectively on said opposite sides; and a shred container disposed below said shredder cover to receive shreds from said shredder, said shred container having an open end which includes two opposite edges respectively provided with pivot seats, said pivot members being mounted respectively on said pivot seats so that said shredder cover is mounted on said shred container and said shredder cover is turnable about the axes of said pivot members;

wherein said shredder cover includes a handle at one side of said pivot members which are symmetrically opposite to each other, said handle capable of being used as the point of force application for turning and opening said shredder cover, whereby said shredder cover can be rotated about the axes of said pivot members;

wherein said shredder cover is rotated about the axes of said pivot members between an open position, in which said shredder cover is turned to an angular position so as to expose said open end of said shred container to permit access to said shred container, and a closed position, in which said shredder cover covers said open end of said shred container;

wherein each of said pivot seats is in the form of a curved wall that is indented downwardly from said open end of said shred container, each of said pivot members being at least partially cylindrical in cross-section;

one of said shredder cover and said pivot seats further comprising a pair of rotation limiting members; and each of the rotation limiting members projecting radially, and each being adapted to abut against a respective edge on the other of said shredder cover and said pivot seats so as to restrict angular rotation of said shredder cover relative to said shred container when said shredder cover is turned to said open position.

* * * * *